US006079052A

United States Patent [19]

Veridiano

[11] Patent Number: 6,079,052

[45] Date of Patent: Jun. 27, 2000

[54] HEADGEAR WITH REMOVABLE FORWARDLY EXTENDING SIDE FLAPS

[76] Inventor: Carlos H. Veridiano, 11566 Grande Vista Pl., Whittier, Calif. 90601

[21] Appl. No.: 09/356,641

[22] Filed: Jul. 19, 1999

[51] Int. Cl.[7] ..... A42B 1/06

[52] U.S. Cl. ..... 2/172; 2/195.1; 2/10

[58] Field of Search ..... 2/172, 10, 195.1, 2/206, 209, 423, 209.11, 195.2, 9

[56] References Cited

U.S. PATENT DOCUMENTS

| | | | |
|---|---|---|---|
| 1,512,128 | 10/1924 | O'Brien | 2/172 |
| 1,639,468 | 8/1927 | Rosenberg et al. | 2/172 |
| 2,501,760 | 3/1950 | Dahlstedt . | |
| 2,878,479 | 3/1959 | Schuessler . | |
| 4,321,708 | 3/1982 | Troiano | 2/172 |
| 4,486,903 | 12/1984 | Krystal | 2/172 |
| 4,845,782 | 7/1989 | Gregg | 2/172 |
| 5,119,514 | 6/1992 | Woehl | 2/172 |
| 5,161,259 | 11/1992 | Shorts | 2/199 |
| 5,351,343 | 10/1994 | Harbison | 2/423 |
| 5,493,733 | 2/1996 | Pospisil | 2/195.1 |
| 5,884,334 | 3/1999 | Collette et al. | 2/10 |

*Primary Examiner*—Amy B. Vanatta

*Attorney, Agent, or Firm*—Gene Scott-Patent Law & Venture Group

[57] ABSTRACT

A cap or visor provides for side flaps that may be folded upwardly so as to be out of the sight of the wearer and may alternately be folded downwardly for shading the side and front of the face and upper neck. In either case the forward extending ends of the flaps may be joined with either the upper portion of the cap or headband portion of a visor, or with the free end of the visor portion in at least two different positions so as to adjust the level of shading or to adjust the position of the flaps with respect to the upper portion of the cap. The flaps provide shading protection along the sides of the head as well as forward of the face along both sides of the visor. In an alternative embodiment the side flaps are attached to the cap or visor by Velcro® fastener material.

7 Claims, 3 Drawing Sheets

HEADGEAR WITH REMOVABLE FORWARDLY EXTENDING SIDE FLAPS

For common matter therein, this continuation-in-part application claims the priority date of a previously filed utility application having Ser. No. 09/231,144 and an assigned filing date of Jan. 15, 1999 and which contains subject matter similar to that described and claimed in the present application.

BACKGROUND OF THE INVENTION

1. Field of the Invention

This invention relates generally to hats, visors and caps, and more particularly to a cap having side flaps for shading the side and forward portion of the face from direct sunlight, the flaps being retractable.

2. Description of Related Art

The following art defines the present state of this field:

Pospisil, U.S. Pat. No. 5,493,733 describes a cap having an arrangement for shielding the ears of a wearer from direct sunlight by the use of a pair of generally elongate ear shades removably supported from the sides of the cap. This novel cap has head-encircling portion and crown portion as well as support devices for the ear shades. These support devices are mounted on opposite sides of the head-encircling portion, at locations generally corresponding to the temporal portions of a wearer's head. Each of the support devices is adapted for supporting one of the ear shades, with both of the ear shades being double-ended and of non-planar construction. A securing component is disposed on each end of each ear shade, adapted for engagement with the respective support device. Each ear shade, when mounted in one orientation on a respective support device, is disposed relatively close to the respective ear of the wearer, such that the ear will be shaded from the sun, whereas when mounted on the support device in an opposite orientation, the ear shade will be disposed in a position relatively close to the crown of the cap, leaving the respective ear unshaded.

Harbison, U.S. Pat. No. 5,351,343 describes an ear flap hat that is designed to be worn in both good and bad weather. The hat gives the wearer the flexibility of wearing the hat with the ear flaps down covering the wearer's ears or positioning the ear flaps in an up position on the crown of the wearer's head so that the wearer's ears are exposed. A cord and cord lock are also included with this hat so that the wearer can tighten the cap down and affix it to their head when the ear flaps are down. The cord can also be used to hold the earflaps in the up position when they are not covering the wearer's ears. When the earflaps are in the down position, covering the wearer's ears, the cord can be positioned in the back of the wearer's neck or under the wearer's chin depending on the desired tightness and the weather conditions. The hat will be less likely to fly off during gusts of high wind when the cord is positioned under the wearer's chin.

Woehl, U.S. Pat. No. 5,119,514 describes an ear shield cap suitable for shading the wearer's eyes and ears from direct exposure to the rays of the sun which may be adjustable for a number of usual head sizes without undue affect on the shading function. The cap has a visor extending from the front of the crown, a pair of ear shields extending from the sides of the crown and the rear of the crown is free of any extension and structured to adjust the cap to the head size of various wearers. The visor and ear shields are joined to provide a uniform transition from a visor to the ear shields. The cap may include a rear gore or panel in the crown of stretchable material to provide size adjustment or the rear of the crown may have a cutout which is bridged or spanned by a tab which may be an elastic band, a mating Velcro fastener or a snap fastener adjustable to variable lengths. The cap may be of the baseball cap-type construction made with materials and features permitting air circulation about the wearer's head.

Krystal, U.S. Pat. No. 4,486,903 is an adjustable cap with a back opening and a strip of adjustable length whereby the cap can be adjusted as to size that has an inband that can be stored in the head cover or folded downwardly to cover the ears. The inband pattern has an upper edge that curves downwardly on each side of a center portion so that when it is sewn into the cap the end portions of the inband are stressed to bias them inwardly to hug the head and ears in use.

Troiano, U.S. Pat. No. 4,321,708 is a golf hat having a visor provided with a pair of blinders for the eyes of the wearer of the hat. The blinders are pivoted to the sides of the visor and locked in place upon the visor by Velcro pads when not in use, and pivoted downwardly towards the eyes of the wearer when in use. When in the non-use position, the blinders conform to the contour of the visor so that they are not readily noticeable.

Shorts, U.S. Pat. No. 5,161,259 relates to a neck covering protective garment that comes as a two piece garment for wearing around the head and neck. The rear piece covers the back of the neck from sunburn and is attached to the rear adjustment strap of a standard baseball cap. The rear piece is readily detachable from the baseball cap and uses an upper strap that goes around the bill of the cap and a second attaching portion for attaching the rear piece to the ball cap.

Schuessler, U.S. Pat. No. 2,878,479 is a visor-equipped cap, comprising a double-ply crown portion secured to a visor, a knitted swatch having an upper severed, substantially straight end extending between the plies of the crown and stitched thereto, said swatch having its lower portion provided centrally with a V-recess and with a point on each side of the recess, the forward edge of each point extending over the visor of the cap and being stitched between the crown plies thereabove, each of said points being located with respect to the sides of the cap to form ear-covering portions when the visor of the cap is positioned above a wearer's face, the portion of said swatch between the apex of said recess and the upper severed end being positioned between said plies.

Helge, U.S. Pat. No. 2,501,760 is a cap comprising a crown portion, a rim portion, a flap extending along and attached to the edge of said rim portion at the sides and the back thereof and shiftable from an upper position in engagement with said rim portion to a lower position in which the flap constitutes a downward extension of part of said rim portion and serves as an ear and neck protector, a spring member extending throughout the length of the flap and arranged to press the flap against the wearer's ears in the lower position of the flap, and fastenings for said spring member rotatably receiving the spring ends, said spring being of such form that the ends thereof may freely turn within the fastenings when changing the flap from one position to another.

The prior art teaches hats with various types of foldable flaps. However, the prior art does not teach that such a cap may be fitted so as to shade the forward portions of a face and that it may be adjusted fixedly for multiple adaptations. The present invention fulfills these needs and provides further related advantages as described in the following summary.

SUMMARY OF THE INVENTION

The present invention teaches certain benefits in construction and use which give rise to the objectives described below.

The present invention provides a shading head gear such as a cap or head band with side flaps that may be folded upwardly so as to be out of the sight of the wearer and may alternately be folded downwardly for shading the side and front of the face and upper neck. In either case the forward ends of the flaps may be joined with either the portion of the head gear in contact with the head or with a visor portion in at least two different positions so as to adjust the level of shading or to adjust the position of the flaps with respect to the upper portion of the cap.

A primary objective of the present invention is to provide a shading head gear having advantages not taught by the prior art.

Another objective is to provide such a head gear with flaps that are placed forward along the visor and which is contiguous with the visor.

A further objective is to provide such a head gear with flaps that may be placed adjacent to the upper portions of the head gear for providing a design alternative to the basic appearance of the head gear.

A still further objective is to provide such a head gear with flaps that may be positioned for creating a pocket for carrying light objects between the flaps and the head gear.

A further objective is to provide such a head gear wherein the flaps are separable from the cap and therefore may be used with the cap or not.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 3:
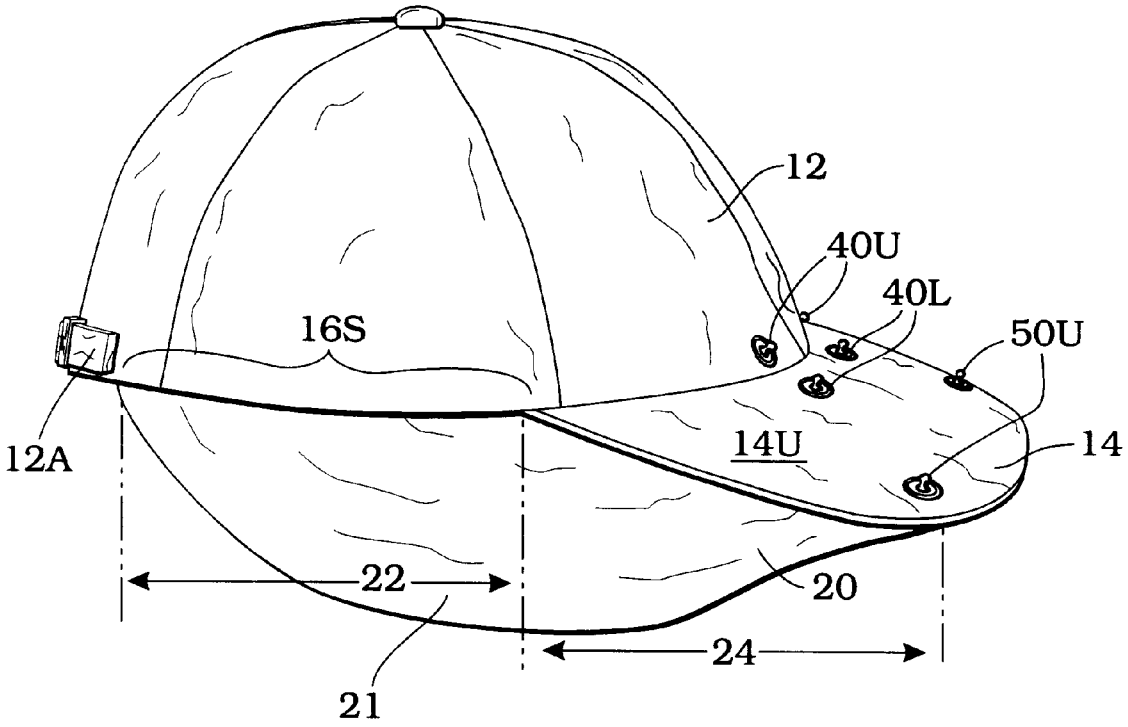
FIGS. 3 & 4 are side elevational views thereof.
Figure 4:
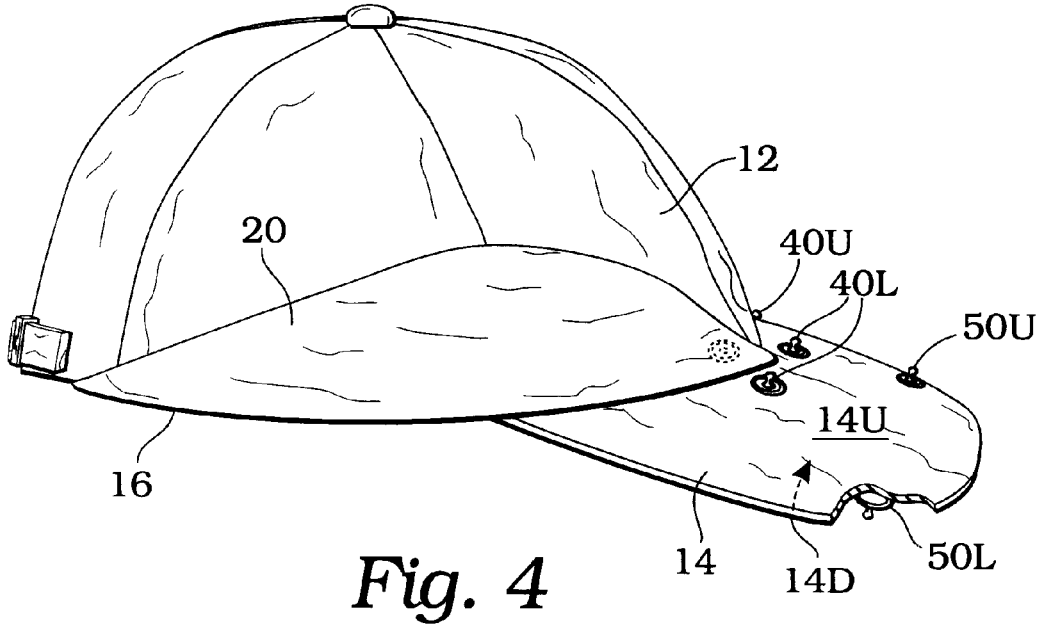

The above described drawing figures illustrate the invention, a head gear apparatus 10 comprising a skull covering portion 12 of preferably a fabric material for covering the upper portion of the skull, as with a baseball cap, or simply a peripheral portion of the skull such as with a head band, and a visor portion 14 of a stiffened fabric material and construction similar to a baseball cap visor. In the preferred embodiment, as shown in the figures, a baseball cap is adapted in accordance with the invention and will be referred to below. The skull covering portion 12 provides a continuous lower peripheral edge 16, which may or may not be interrupted by a hat size adjustment strap 12A at the rear of the skull covering portion 12 as is shown in FIGS. 3 and 4. The peripheral edge 16 is enabled by its placement and the size of the skull covering portion 12, for extending around a wearer's head generally above the wearer's eyes and ears when the skull covering portion 12 is fitted on the top of the wearer's head. The visor portion 14 engages the skull covering portion 12 along a front segment 16F of the peripheral edge 16, the visor portion 14 extending forwardly of the wearer's eyes for shading them. A pair of shading flaps 20 are mounted on opposing sides of the skull covering portion 12 and each has a rear flap portion 22 integral, by sewing or other common permanent attachment means, with the skull covering portion 12 and joined thereto along one side segment 16S of the peripheral edge 16 as clearly shown in FIG. 3, and a forward flap portion 24, free of the skull and visor portions 12, 14; and directed forward of the side segment 16S and terminating forwardly with a first attachment means 30 on an inside surface 21 thereof The attachment means 30 and other attachment means defined below may be simple fabric attachment snaps as is well known in the art and shown in the figures, or may be any other similar type of fastener such as Velcro® strips. A second attachment means 40U & 40L is enabled for engaging the first attachment means 30, i.e., male and female type snap fasteners being joined, the second attachment means being positioned on an upwardly facing surface 14U of the visor portion 14, and/or on the frontal skull covering portion 12 such that with the first 30 and the second 40U or 40L attachment means engaged, the shading flaps 20 being positioned primarily adjacent to the skull covering portion 12 in a position above the peripheral edge 16. A third attachment means 50U & 50L, of the same type as prior, is enabled for engaging the first attachment means 30, the third attachment means being positioned distally on the visor portion 14, such that with the first 30 and the third 50U or 50L attachment means engaged, the rear flap portions 22 are extended downwardly from the side segments 16S, and the forward flap portions 24 extended downwardly from the visor portion 14 for shading the wearer's ears and face sides.

The second attachment means 40U is positioned frontally on the skull covering portion 12 so that the flap portions 20 are positioned adjacent to, but not abutting, the skull covering portion 12. A space 60 is thus created in between the skull covering portion 12 and the flap portion 20 for carrying fishing lures, etc.

The second attachment means 40L is positioned frontally and proximally on the visor portion so that the flap portions 20 are positioned adjacent to, and abutting, the skull covering portion 12.

The third attachment means 50U is positioned on an upwardly facing surface 14U of the visor portion 14 for partially retracting the forward flap portion 24 of the shading flaps 20 so as to provide less shading coverage to the face of the wearer.

The third attachment means 50L is positioned on a downwardly facing surface 14D of the visor portion 14 for fully extending the forward flap portion 24 of the shading flaps 20 for shading more of the face of the wearer.

Figure 1:
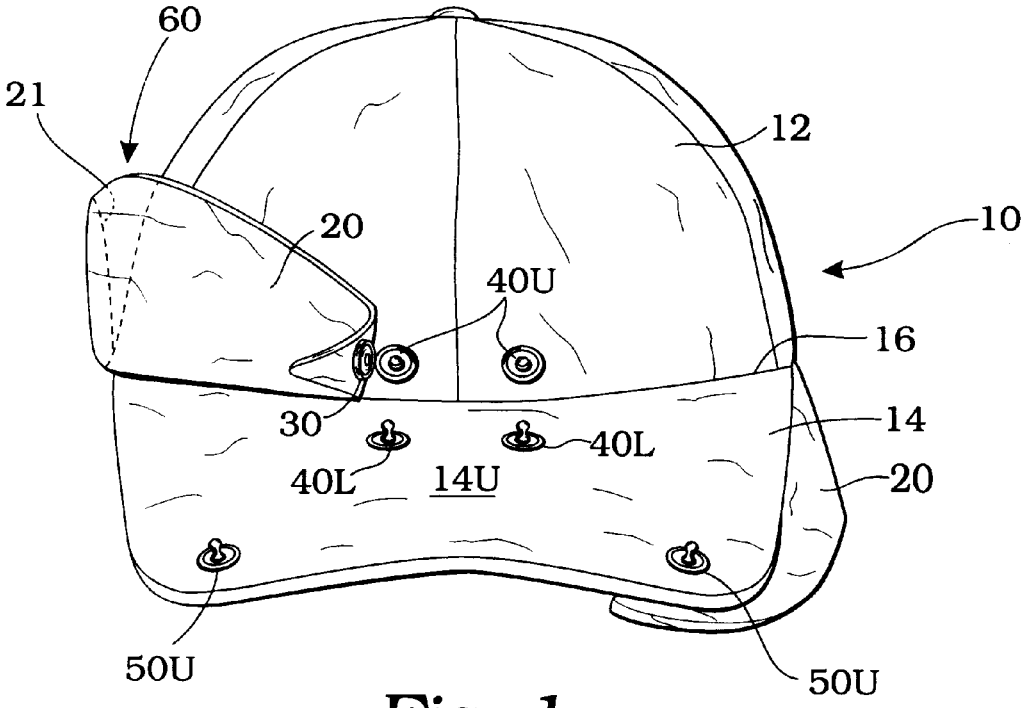
FIGS. 1 & 2 are front elevational views of the preferred embodiment of the present invention.
Figure 2:
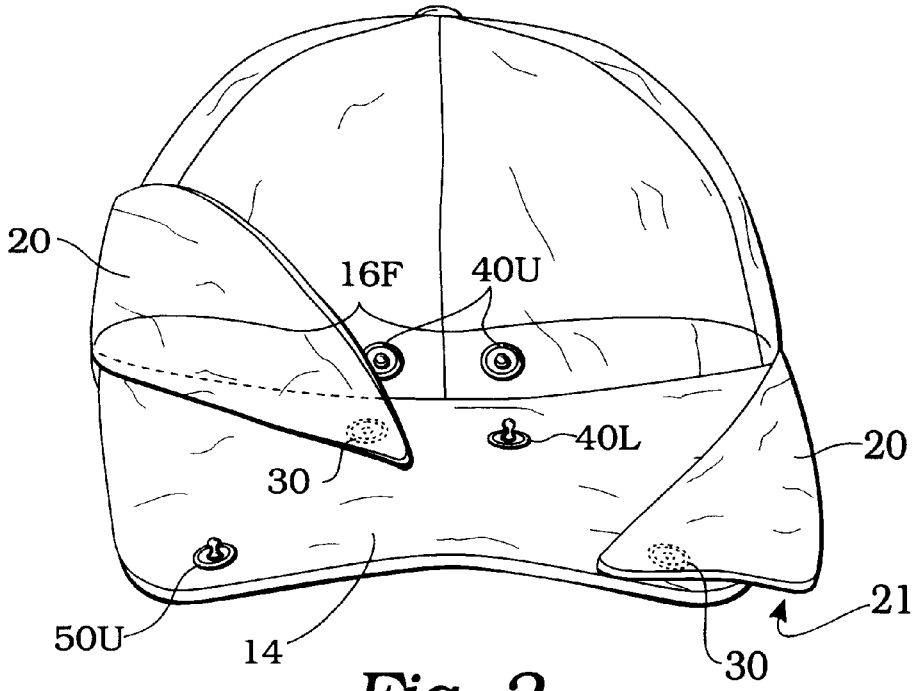

In use, the flaps 20 may be folded upwardly tightly against the cap 10, as seen in FIG. 2, so as to enable a tight fold for insertion of papers such as paper money, i.e., the cap may be used to carry certain items which may be best carried above the head, such as when fishing. They may be also folded upwardly but loosely so as to hold larger items such as fishing lures as seen in FIG. 1. The flaps may also be folded downwardly to shade the face in two separate manners for more or less shading effectiveness.

Figure 5:
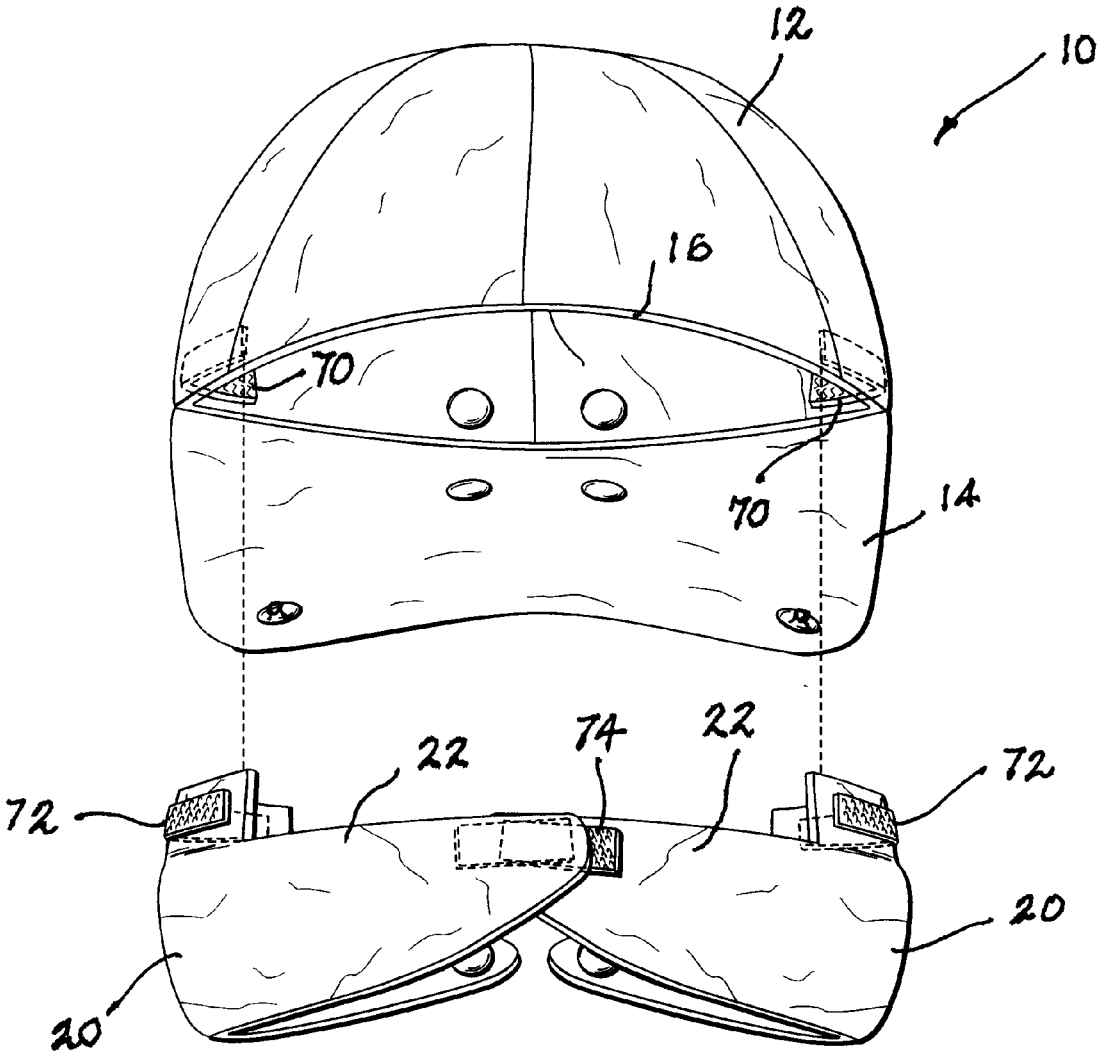
FIG. 5 is a rear elevational view thereof showing an alternative embodiment wherein the flaps of the invention are removable from the cap proper.

In an alternate embodiment, shown in FIG. 5, the shading flaps 20 of the apparatus are removably joined to the skull covering portion 12 of the apparatus, the skull covering portion providing a first part of a surface attachment means 70 interiorly, such as horizontally oriented strips of Velcro® brand hook and loop fasteners. The shading flaps 20 each provide a corresponding, and mating, second part of the surface attachment means 72 exteriorly, again, the mating Velcro® strips. The first and second parts of the surface attachment means 70, 72 are joinable for securing the shading flaps 20 to the skull covering portion 12 of the apparatus. The rearward flap portion 22 of each of the shading flaps 20, in this embodiment, as shown in FIG. 3, includes a further surface joining means 74, preferably Velcro® strips, positioned and adapted for mutually and adjustably joining the rearward flap portions 22 of the shading flaps 20 so as to enable diametrical adjustment of the shading flaps 20, i.e., adjustment for tight fitting onto the head both when the flaps 20 are in the downwardly extending position and when up as previously described.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A head gear apparatus comprising:

a skull covering portion for covering at least a peripheral portion of a wearer's head and a visor portion for extending forwardly of the wearer's head, the skull covering portion providing a continuous peripheral edge, the peripheral edge enabled for extending around the wearer's head generally above the wearer's eyes and ears when the skull covering portion is fitted onto the wearer's skull, the visor portion engaging the skull covering portion along a front segment of the peripheral edge and extending forward of the wearer's eyes for shading thereof;

a pair of shading flaps each having a rear flap portion integral with the skull covering portion and joined thereto along one side segment of the peripheral edge, and a forward flap portion, free of the skull and visor portions and directed forward of the side segment and terminating forwardly with a first attachment means on an inside surface thereof;

a second attachment means enabled for engaging the first attachment means, the second attachment means positioned on an upwardly facing surface of the visor portion, such that with the first and the second attachment means engaged, the shading flaps are positioned primarily in contact with the skull covering portion in a position above the peripheral edge;

a third attachment means enabled for engaging the first attachment means, the third attachment means positioned distally on the visor portion, such that with the first and the third attachment means engaged, the rear flap portions extend downwardly from the side segments and the forward flap portions extend downwardly from the visor portion for shading the wearer's ears and face sides.

2. The apparatus of claim 1 wherein additional second attachment means are positioned frontally on the skull covering portion so that the flap portions are positioned adjacent to, but not abutting, the skull covering portion.

3. The apparatus of claim 1 wherein the second attachment means is positioned frontally and proximally on the visor portion so that the flap portions are positioned adjacent to, and abutting, the skull covering portion.

4. The apparatus of claim 1 wherein the third attachment means is positioned on an upwardly facing surface of the visor portion for partially retracting the forward flap portion of the shading flaps.

5. The apparatus of claim 1 wherein the third attachment means is positioned on a downwardly facing surface of the visor portion for fully extending the forward flap portion of the shading flaps.

6. The apparatus of claim 1 wherein the shading flaps are removably joined to the skull covering portion of the apparatus, the skull covering portion providing a first part of a surface attachment means interiorly, the shaping flaps each providing a corresponding and mating second part of the surface attachment means exteriorly, the first and second parts of the surface attachment means being joinable for securing the shading flaps to the skull covering portion of the apparatus.

7. The apparatus of claim 6 wherein a rearward flap portion of each of the shading flaps includes a further surface joining means positioned and adapted for mutually and adjustably joining rearward terminal ends of the shading flaps so as to enable diametrical adjustment of the shading flaps.

* * * * *